US005591526A

United States Patent [19]

Abrams et al.

[11] Patent Number: 5,591,526

[45] Date of Patent: Jan. 7, 1997

[54] EXPANDED PTFE FIBER AND FABRIC AND METHOD OF MAKING SAME

[75] Inventors: Brad F. Abrams, Wilmington, Del.; Raymond B. Minor, Elkton, Md.; Gordon L. McGregor, Landenberg; John W. Dolan, Boothwyn, both of Pa.

[73] Assignee: W. L. Gore & Associates, Inc, Newark, Del.

[21] Appl. No.: 260,141

[22] Filed: Jun. 15, 1994

[51] Int. Cl.[6] ..... D02G 3/00

[52] U.S. Cl. ..... 428/401; 428/397; 428/407; 428/365; 428/364

[58] Field of Search ..... 264/210, 288, 264/175, 127, 210 R; 161/189, 402, 411, 165; 428/364, 327, 317.9, 365, 407, 397, 401

[56] References Cited

U.S. PATENT DOCUMENTS

| | | | |
|---|---|---|---|
| 3,664,915 | 5/1972 | Gore | 161/164 |
| 3,813,461 | 5/1976 | Murayama et al. | 46/89 |
| 3,953,566 | 4/1976 | Gore . | |
| 4,619,641 | 10/1986 | Schanzer | 604/8 |
| 5,258,105 | 11/1993 | Kaczur et al. | 204/95 |
| 5,306,869 | 4/1994 | Springer et al. | 174/36 |
| 5,344,561 | 9/1994 | Pall et al. | 210/208 |
| 5,348,683 | 9/1994 | Kaczur et al. | 252/187 |

FOREIGN PATENT DOCUMENTS

| | | |
|---|---|---|
| 0391887 | 10/1990 | European Pat. Off. . |
| 9308321 | 4/1993 | WIPO . |

OTHER PUBLICATIONS

PCT International Search Report for PCT/US94/11691 (2 pages).

*Primary Examiner*—Patrick J. Ryan
*Assistant Examiner*—Merrick Dixon
*Attorney, Agent, or Firm*—David J. Johns

[57] ABSTRACT

The present invention is an expanded polytetrafluoroethylene (PTFE) fiber with improved handling properties. Unlike previous expanded PTFE fibers, the fiber of the present invention employs a fiber of increased thickness so that the fiber is maintained in an unfolded orientation. The improved processing steps of the present invention create a fiber that has a number of improved properties, including more uniform dimensions along its length, improved compressibility and handling, and when woven into a fabric, the fabric is more easily processed, is of higher quality, and is more uniform.

7 Claims, 6 Drawing Sheets

EXPANDED PTFE FIBER AND FABRIC AND METHOD OF MAKING SAME

BACKGROUND OF THE INVENTION

1. Field of the Invention

The present invention relates to fiber and fabrics made from such fiber material, and particularly fibers and fabrics made from expanded polytetrafluoroethylene (PTFE).

2. Description of Related Art

Since the development of the invention of U. S. Pat. No. 3,953,566 to Gore, flexible fibers made from expanded polytetrafluoroethylene (PTFE) have been used for a variety of purposes, including as a fiber used as a thread and as a component in woven fabrics. These fibers and the fabrics incorporating them have a number of substantial improvements over previous materials. For example, expanded PTFE fibers are chemically inert, are resistant to high temperatures, have high tensile strength, have a high dielectric constant, and are highly lubricious. Additionally, these materials can be treated to impart other desirable properties, such as being filled to provide thermal and/or electrical conductivity.

One of the problems with expanded PTFE materials is that they tend to be difficult to process and they can have a number of structural problems. For instance, unlike some yarns and fibers used for weaving, such as nylon or polyester formed from multiple filaments twisted into a fiber with uniform dimensions, expanded PTFE fibers have generally been formed from a thin, flat tape slit into single filament strands and then folded prior to the spooling process. This folding process is difficult to control during processing and to maintain in the final product, thus resulting in a fiber with inconsistent width and thickness along its length. Also, it has been believed that leaving thin edges of expanded PTFE fiber exposed during processing can cause the fiber to fibrillate.

In an attempt to address some of these concerns, a number of alternative expanded PTFE fiber constructions have been attempted. Folding and/or twisting the expanded PTFE fiber can significantly reduce its tendency to fray or fibrillate. Unfortunately, these processing steps are often difficult to perform while maintaining uniform width and thickness dimensions. Moreover, for certain applications where a very flat weave is desired, these alternative processing steps have been relatively unsuccessful in delivering a suitable product.

Presently, other polymeric fibers have been used to produce flat weave fabrics, such as polyester fiber. Although the proper woven structure can be created in this manner, these other materials simply do not supply sufficient release properties and chemical inertness to allow them to be used in more demanding applications. Another approach to producing a flat weave fabric with improved release properties has been to supply a fluoropolymer coated fiber. This can provide significant improvement in at least initial operation, but performance tends to diminish substantially over time due to coating abrasion, nicks, or delamination. In particularly harsh or demanding applications, such diminished performance simply cannot be tolerated.

Accordingly, it is a primary purpose of the present invention to provide a flat fiber suitable for weaving into a fabric that can be used in harsh environments.

It is a further purpose of the present invention to provide a flat woven fabric that has good release properties, preventing the adhesion of materials.

It is another purpose of the present invention to provide an expanded PTFE fiber material of uniform width dimensions which retains these uniform width dimensions when woven into a fabric.

It is still another purpose of the present invention to provide an expanded PTFE fiber for use in a fabric that is not folded or twisted prior to or during weaving while being resistant to fraying, fibrillation, and shredding.

These and other purposes of the present invention will become evident from review of the following specification.

SUMMARY OF THE INVENTION

The present invention comprises an improved expanded polytetrafluoroethylene (PTFE) flat fiber suitable for weaving into a fabric and a flat fabric constructed from such a material. The fiber of the present invention achieves the necessary dimensions for a flat weave by maintaining a uniform width and an unfolded orientation along its entire length. This is accomplished by employing a relatively thick expanded PTFE sheet that is slit and optionally further expanded to the final width of the fiber and carefully wound on spools to avoid rolling, folding, or bending. Preferably, the fiber comprises a minimum, unfolded, thickness of 75 μm and a minimum width of 0.7 mm.

A fabric constructed of a flat weave is meant to describe a woven construction which has a surface that is relatively smooth. Weave patterns, such as dutch twills and satin twills, are constructed to have a relatively smooth surface. Fabrics such as these can be further enhanced to increase the contact surface of the material. This can be accomplished by using a flat, rectangular fiber which has relatively high aspect ratio of width to thickness. When woven into a fabric the fibers of the present invention may be oriented to have the width of the fiber at the top planar surface of the fabric. Flat fibers used in fabrics can therefore provide more surface contact area than a similarly constructed fabric of round cross section fibers. Flat fibers which have a smooth surface can also provide better release properties than rough surface fibers or multifilament fibers. Furthermore, flat fibers which have a consistent cross section are better for controlling porosity of the fabric for filtration materials.

The fabric of the present invention has numerous advantages over presently available expanded PTFE fiber fabrics and flat weave fabrics made from other materials. Among the advantages of the present invention are: retained properties of expanded PTFE fiber, including chemical inertness, high temperature resistance, and excellent release properties; uniform dimensions along the entire length of the fiber used in the present invention, making it easier to weave and producing a far more consistent end product; greater resistance to fibrillating or fraying along the edges of the flat expanded PTFE fiber used to create the fabric of the present invention; and significantly improved compressibility and, as a result, improved handling and use properties. The fabric of the present invention is particularly suitable for use in demanding environments requiring flat weave fabrics, e.g., as a conveyor web or belt, printing screens, filtration screens, etc.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved fiber material, particularly suitable for weaving into a unique fabric.

The fiber of the present invention comprises a relatively thick strand of expanded polytetrafluoroethylene (PTFE) fiber that is essentially rectangular to oblong in cross-sectional dimensions, has high aspect ratio, and is formed substantially without folds or creases. In order to form the fiber without folding one or both of its edges over itself, as is typical with existing expanded PTFE fiber, it is particularly important that the fiber of the present invention is formed to have a significantly greater thickness than presently available PTFE fibers. For example, prior to folding, one conventional expanded PTFE fiber produced under the trademark RASTEX® by W. L. Gore & Associates, Inc., initially has dimensions of about 40 μm in thickness and about 2 mm in width. When this material is folded and wound on spools, the material typically has dimensions of about 90 μm in thickness and about 1.2 mm in width.

Figure 1:
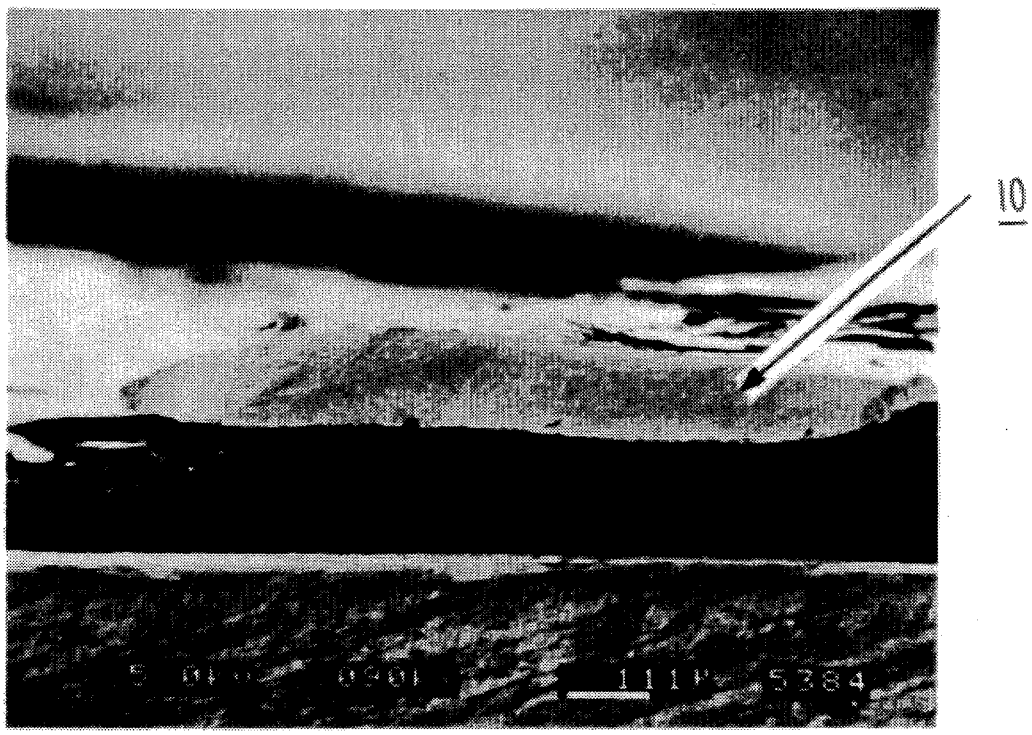
FIG. 1 is a scanning electron micrograph (SEM) of a cross-section of a fiber of the present invention enlarged 90 times.
Figure 2:
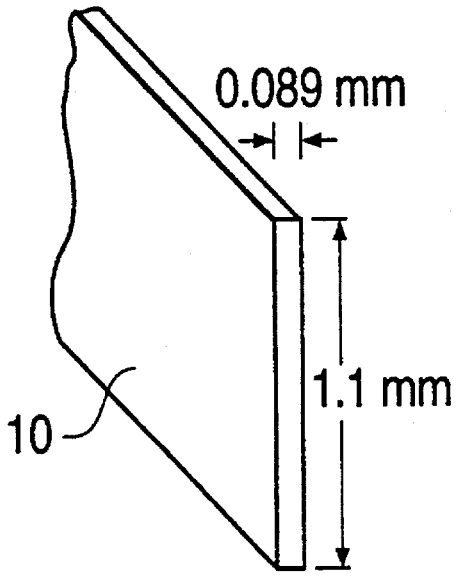
FIG. 2 is a three-quarter isometric view of a fiber of the present invention.

As is shown in FIGS. 1 and 2, the fiber 10 of the present invention is about 50 to 250 μm and preferably 75 to 150 μm in thickness and about 0.5 to 3 mm and preferably 0.7 to 1.5 mm in width. The substantial thickness of this material allows the fiber to function extremely well without need for folding or otherwise bulking the height of the material. Additionally, the fiber comprises an essentially rectangular to oblong cross-sectional shape with a high aspect ratio similar to that obtained by other non-fluoropolymer weaving fibers. As a result, the fiber of the present invention has proven to be highly resistant to fibrillating along its edges during weaving or subsequent processing. Correction of the fibrillation problem is an important advancement over previous expanded PTFE fiber materials where a primary purpose of folding was to reduce the number of exposed edges subject to fibrillation. Reducing fibrillation without need for folding or otherwise protecting the edges of the fiber is particularly noteworthy.

The fiber of the present invention is produced through a series of unique processing steps. First, an expanded PTFE sheet is acquired or formed. Such material is now available in a variety of forms from a number of commercial sources, such as from W. L. Gore & Associates, Inc., Elkton, Md., under the trademark GORE-TEX®. This material may be formed as taught in U.S. Pat. No. 3,543,566 to Gore, incorporated by reference. The preferred sheet comprises the following ranges of dimensions and properties: a thickness of about 0.5 to 1.0 mm; a density of about 0.8 to 1.5 g/cc; and a tenacity of about 0.5 to 1.0 g/tex.

Each of these properties are measured in a conventional manner. Length, width and thickness are determined through any conventional means, such as through the use of calipers or through measurements through a scanning electron microscope. Density is determined by dividing the measured weight of the sample by the computed volume of the sample. The volume is computed by multiplying the measured length, width, and thickness of the sample. Tenacity is calculated by dividing the sample's tensile strength by its normalized weight per unit length (tex [grams/1000 meters] or denier [grams/9000 meters]).

Bulk tensile strength is measured by a tensile tester, such as an INSTRON Machine of Canton, Mass. In the case of sheet goods, the INSTRON machine was outfitted with clamping jaws which are suitable for securing the sheet goods during the measurement of tensile loading. The cross-head speed of the tensile tester was 25.4 cm per minute. The gauge length was 10.2 cm. In the case of fibers, the INSTRON machine was outfitted with fiber (horn type) jaws that are suitable for securing fibers and strand goods during the measurement of tensile loading. The cross-head speed of the tensile tester was 25.4 cm per minute. The gauge length was 25.4 cm.

This sheet may then be slit into strands by passing the sheet through a series of gapped blades set apart 0.5 to 20 mm. After cutting, the fibers may be subjected to a further heat treatment and/or expansion step, such as through the processes discussed below. Finally, the fibers should be wound onto spools with care taken to avoid rolling or folding of the fibers during the spooling process.

Preferably, an expanded PTFE sheet is formed and slit into fibers of the present invention in the following manner. A fine powder PTFE resin is blended with a lubricant, such as odorless mineral spirits, until a compound is formed. The volume of lubricant used should be sufficient to lubricate the primary particles of the PTFE resin such to minimize the potential of the shearing of the particles prior to extruding. The compound is then compressed into a billet and extruded, such as through a ram type extruder, to form a coherent extrudate. A reduction ratio of about 30:1 to 300:1 may be used (i.e., reduction ratio=cross-sectional area of extrusion cylinder divided by the cross-sectional area of the extrusion die). For most applications a reduction ratio of 75:1 to 100:1 is preferred.

The lubricant may then be removed, such as through volatilization, and the dry coherent extrudate is expanded in at least one direction 1.1 to 50 times its original length (with 1.5 to 2.5 times being preferred). Expansion may be accomplished by passing the dry coherent extrudate over a series of rotating heated rollers or heated plates.

Once this sheet is formed, the sheet may be formed into a fiber by slitting the dry coherent expanded extrudate into predetermined widths by passing it between a set of gapped blades or other cutting means. Following cutting, the slit coherent extrudate may then be further expanded in the longitudinal direction at a ratio of 1.1:1 to 50:1 (with 15:1 to 35:1 being preferred) to form a fiber. Finally, this fiber may be subjected to an amorphous locking step by exposing the fiber to a temperature in excess of 342° C.

The final dimensions of the fiber should comprise: a width of about 0.5 to 3.0 mm; a thickness of about 50 to 250 μm; a weight/length of about 80 to 450 tex; a density of about 1.0 to 1.9 g/cc; a tensile strength of about 1.5 to 15 kg; and a tenacity of about 10 to 40 g/tex.

The width of the fiber can be controlled by several process variables known in the art of expanding PTFE. Variables which can affect the width of the fiber are slit width, expansion temperatures, and expansion ratio.

Figure 3:
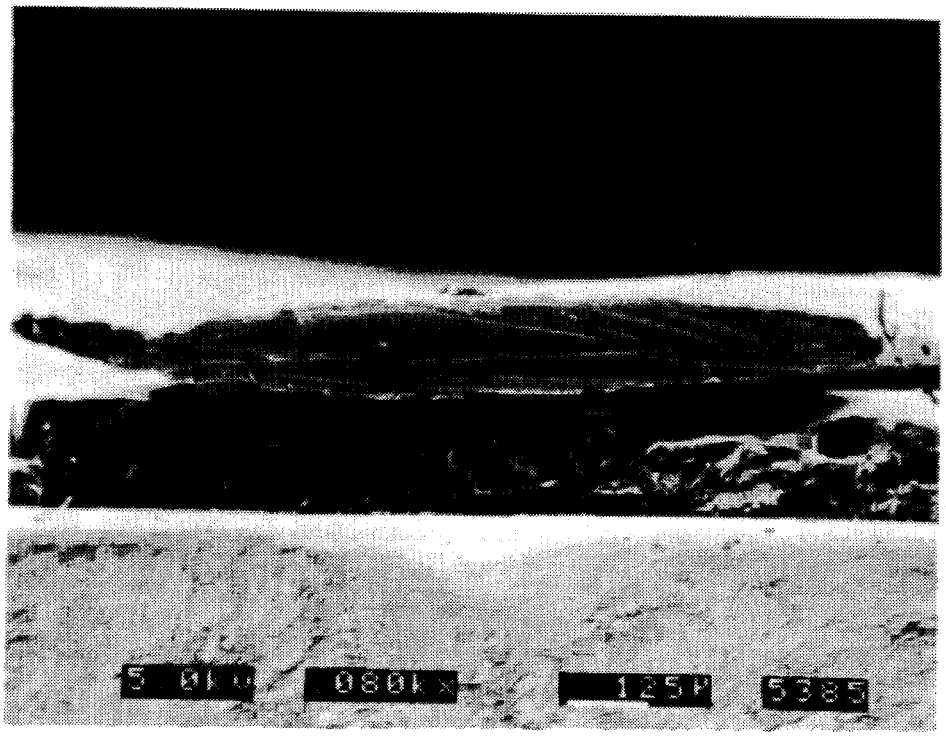
FIG. 3 is an SEM of a cross-section of one commercially available fiber enlarged 80 times.

The properties of a fiber made in accordance with the above procedures differ considerably from previous PTFE and expanded PTFE fibers. A conventional porous expanded PTFE fiber, such as that sold under the trademark RASTEX® by W. L. Gore & Associates, Inc., is shown in FIG. 3. This fiber performs well where porosity, fabric finish, and thickness are not critical. However, as can be seen in this SEM, this fiber is folded upon itself. This processing step has heretofore been considered important in order to increase the thickness of the fiber and to reduce the number of exposed edges of the fiber so as to minimize the chance of fibrillation. As a result, it has been difficult to maintain a consistent thickness or surface in the final fiber product. This folding process is difficult to execute consistently and, as is explained in greater detail below, constrains the properties of the fiber.

Figure 4:
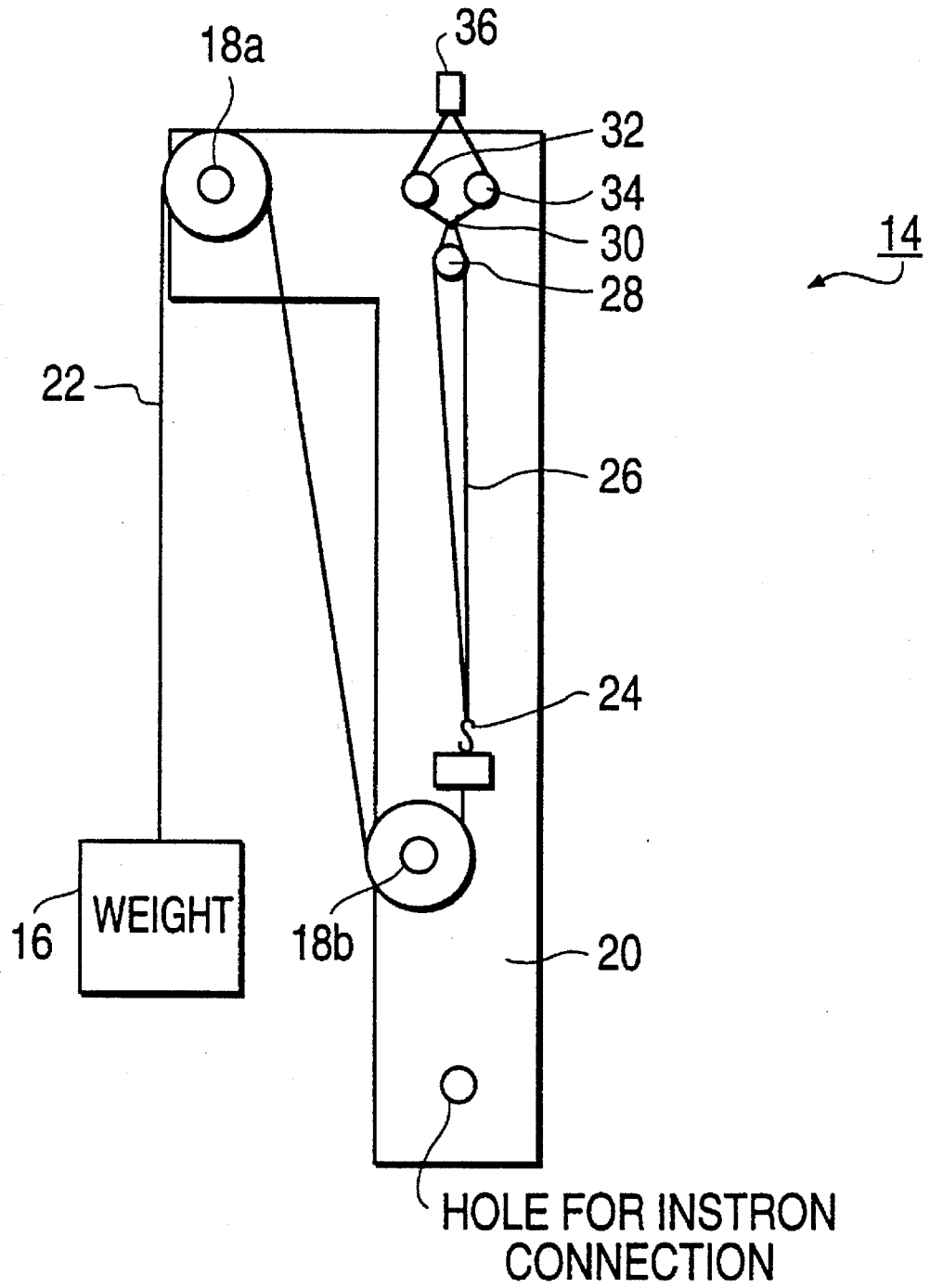
FIG. 4 is a schematic representation of apparatus used to test the fibrillation of the fiber of the present invention.

The deficiencies of existing fiber as compared to a fiber of the present invention can be demonstrated by a test of relative fibrillation resistance between the fibers. A fibrillation resistance test was performed with an existing fiber and the fiber of the present invention which is outlined below:

An apparatus 14 employed in the fibrillation resistance test is illustrated in FIG. 4. The apparatus 14 comprises a 900 gram weight 16 hung from a pulley system 18*a*, 18*b* attached to an L-shaped metal plate 20. One end of a string 22 holds the weight 16 while the other end is threaded through the pulley system 18*a*, 18*b* and tied to an S-hook 24. The S-hook 24 anchors the fiber to be tested and incorporates the weight into the system. The center of a 60 cm fiber segment 26 to be tested is looped around the S-hook 24. The fiber then is extended upward around a rod 28 (see above). A half hitch knot 30 is tied over the rod 28 and each fiber segment is separated and fed around rod 32 and rod 34, which are above rod 28. The two fiber ends meet and are wrapped around fiber grips 36 of an INSTRON machine. The test begins as the top INSTRON grip 36 moves upward and runs until the S-hook 24 reaches the rod 26 which corresponds to 12.5 cm of travel.

Careful monitoring of the fiber is performed through an illuminated 1.1× magnifying glass during testing. The fibers were judged to pass or fail the fibrillation test. To pass the test, there must be no apparent fibrillation. Failure occurred if at least one hair or pill was present after a single test run.

Testing was conducted on samples of the inventive fiber and a commercially available expanded PTFE fiber, such as that available from W. L. Gore & Associates, Inc., under the trademark RASTEX®. Seven runs of each fiber was performed. The 900 gram load was kept constant for all fibers. The INSTRON cross head speed was 25.4 cm/minute. The type of knot tied was a half hitch knot, and the orientation was kept constant as left under right.

The cumulative test results are outlined below.

Comparative Fibrillation Testing Results

| | Fiber | Results | | Fiber | Results |
|---|---|---|---|---|---|
| 1 | Inventive Fiber | Pass | 1 | CONVENTIONAL ePTFE fiber | Fail |
| 2 | Inventive Fiber | Fail | 2 | ePTFE fiber | Fail |
| 3 | Inventive Fiber | Pass | 3 | ePTFE fiber | Fail |
| 4 | Inventive Fiber | Pass | 4 | ePTFE fiber | Fail |
| 5 | Inventive Fiber | Pass | 5 | ePTFE fiber | Fail |
| 6 | Inventive Fiber | Pass | 6 | ePTFE fiber | Fail |
| 7 | Inventive Fiber | Pass | 7 | ePTFE fiber | Fail |

The results indicate that there exists a highly significant difference between the fibrillation resistance of the fiber of the present invention and a conventional expanded PTFE folded fiber. The inventive fiber produced only one slight fibril in one of the seven tests, compared with a significant fibrillation with each case of the comparative fiber. Using a one-way analysis of variance, the inventive fiber has a 86%±14 probability of not fibrillating over the other conventional folded expanded PTFE fiber tested.

The fiber of the present invention was also tested to determine its degree of uniformity as compared with existing PTFE fiber material. The dimensions of the fibers were determined through the following procedure:

1. A random place on the fibers length was selected on the fiber by unwinding the fiber off its spool or core.
2. After selecting a starting point at random, the largest and smallest width within a 1 meter section of the random starting point was determined. The width was measured using a magnifying eyepiece having a mm scale of 0.1 mm resolution.
3. This procedure was repeated by selecting another random starting point and repeating step 2.
4. Repeat step 3 until 32 random lengths have been sampled
5. Compute the Delta Width Percent by the following formula.

Delta Width Percent={2*(Max. Width−Min. Width)/(Max. Width+Min. Width}*100

Figure 5:
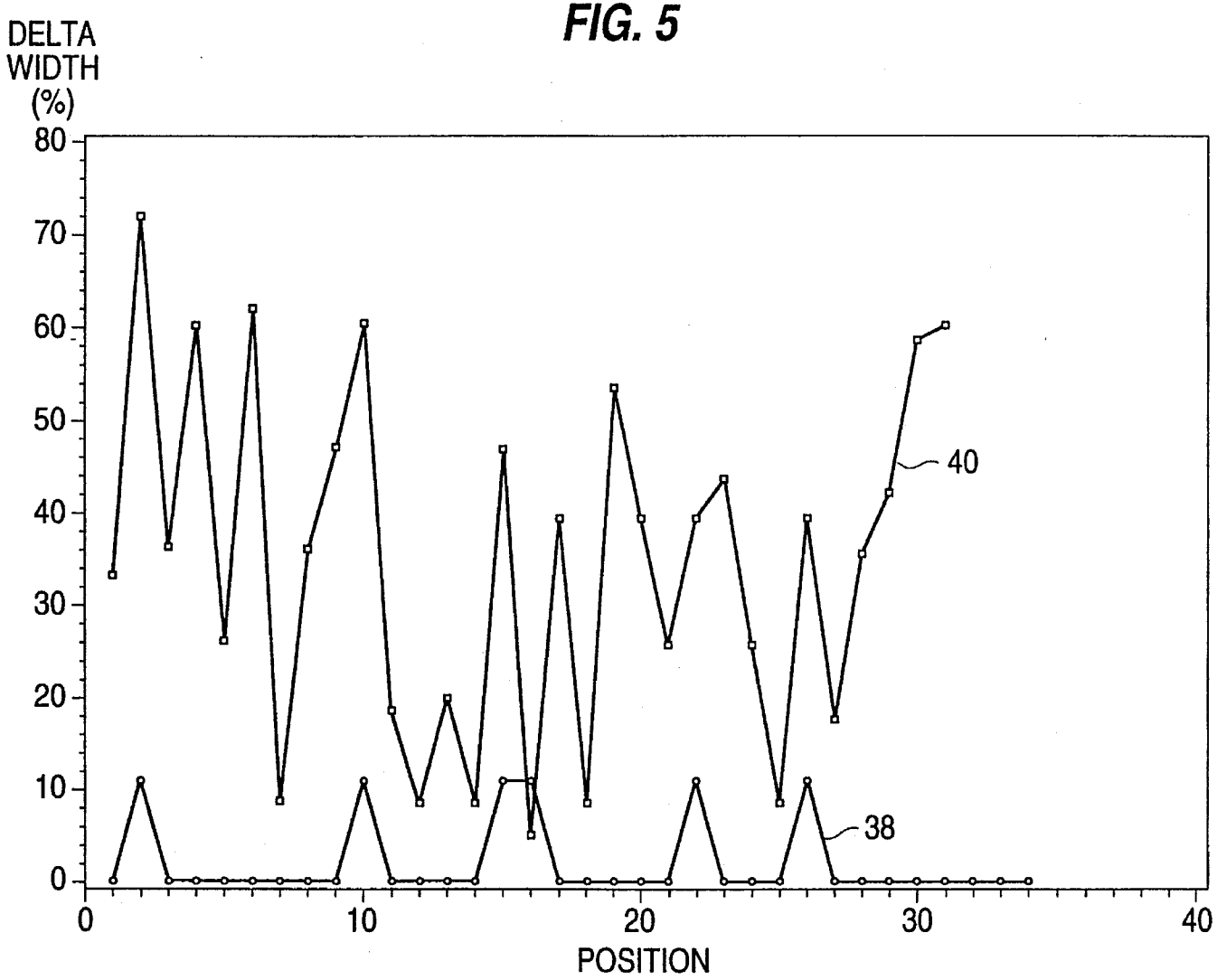
FIG. 5 is a graph of the uniformity of width of the fiber of the present invention as compared with an existing PTFE fiber.

FIG. 5 is a graph that demonstrates the width uniformity of the inventive fiber 38 in comparison with a folded RASTEX® fiber 40. The variable Delta Width Percent is the computed subtraction of the smallest width from the largest width found over a one meter section randomly selected along the fiber's length and dividing this by the average of these minimum and maximum values and multiplying this quantity by one hundred.

The fiber of the present invention was also tested to determine its degree of thickness uniformity as compared with an existing PTFE fiber material. The thickness dimensions of the fibers were determined through the following procedure:

1. Start at a random place on the fiber's length by selecting a point on the fiber by unwinding the fiber off its spool or core.
2. After selecting a starting point at random, find the largest and smallest thickness within a 50 cm section (at least ten measurements must be taken) starting from the random starting point. Measure the thickness using a snap gauge having a precision of 0.0001 inch (2.54 μm).
3. Continue by selecting another random starting point and repeat step 2.
4. Repeat step 3 until ten random lengths have been sampled.
5. Compute the Delta Thickness Percent by the following formula.

Delta Thickness Percent={2*(Max. Thickness−Min. Thickness)/(Max. Thickness+Min. Thickness}*100

Figure 6:
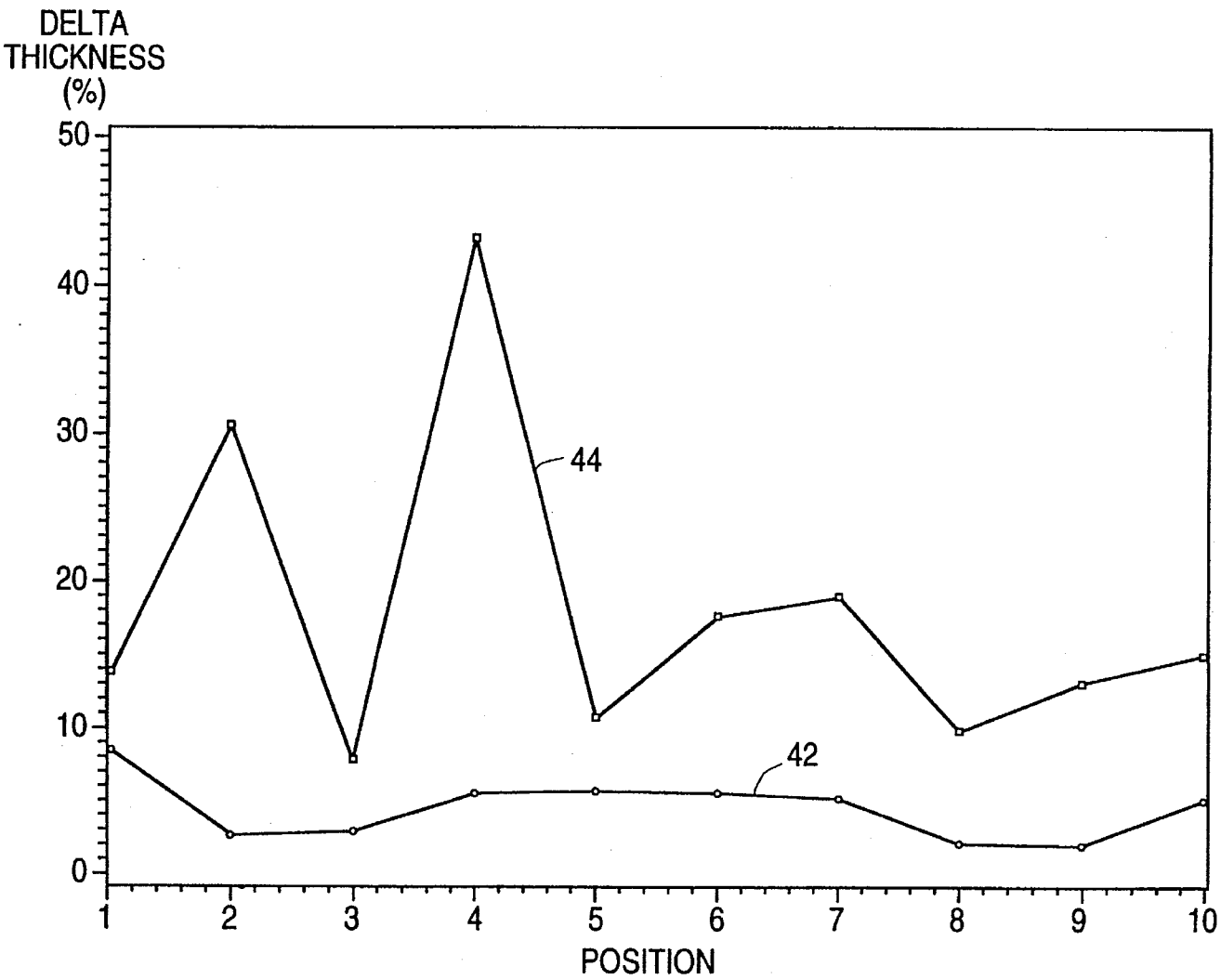
FIG. 6 is a graph of the uniformity of thickness of the fiber of the present invention as compared with an existing PTFE fiber.

FIG. 6 is a graph that demonstrates the thickness uniformity of the inventive fiber 42 in comparison with folded RASTEX® fiber 44. The variable Delta Thickness Percent is the computed subtraction of the smallest thickness from the largest thickness found over a 50 cm section randomly selected along the fiber's length and dividing this by the average of these minimum and maximum values and multiplying this quantity by one hundred.

The wide degree of variance in width and thickness measured on this RASTEX® fiber demonstrates the inconsistent results inherent with folded expanded PTFE fiber processing. The above described test demonstrates that the fiber of the present invention is significantly more uniform in both width and thickness than the best available expanded PTFE fiber materials. FIG. 5 depicts that in general, the fiber of the present invention will vary in width only 0 to 15% along its length over a one meter sample. Preferably, the fiber of the present invention will vary in width less than 11% along its length over a one meter sample. FIG. 6 depicts that in general the fiber of the present invention will vary in thickness only 2 to 15% along a 50 cm length. Preferably, the fiber of the present invention will vary in thickness less than 9% along a 50 cm length. "Uniform" is meant to describe fibers that vary approximately 15% or less in width or thickness according to the test described above.

The fiber of the present invention has many improved properties over any previous expanded PTFE fiber material. First, it has increased uniform dimensions along its length which, among other things, when woven into a fabric, the fabric is more easily processed, is of higher quality, and is more uniform. Second, the fiber of the present invention exhibits increased porosity or "void content". The void content is measured by the ratio of the article's bulk density to its intrinsic density. When processed in the manner described, it has been found that the fiber of the present invention remains quite porous and compressible in its completed form and has the ability to densify under low stress. This property makes the fiber easier to handle and may provide previously unavailable processing and end-use advantages.

For example, in a woven fabric, at the intersection of the warp and fill fibers, the fiber can be compressed at the crossovers thereby allowing the overall thickness of the fabric to be reduced without causing the fiber to flow and significantly change fiber width. Through a standard process such as calendering, this can increase the dimensional stability of the fabric by interlocking the intersecting fibers. By minimizing the change in width of the fibers during the calendering process, the flow rate or permeability of the fabric remains essentially unchanged.

As has been explained, one of the exciting properties of the fiber of the present invention is its high degree of compressibility when compared with existing expanded PTFE fibers. In order to quantify this property, the following procedure was performed on a commercially available expanded PTFE fiber, such as that available under the trademark RASTEX®, as compared to the inventive fiber:

1. A piece of fiber was cut approximately 25 cm in length from each spool of fiber;
2. The thickness of the fiber was measured over several regions of the sample using a snap gauge accurate to 0.0001 inch and the average thickness [$T_i$] was computed. In the case of folded fibers, the fiber was carefully unfolded before measuring the thickness. The fiber's thickness is defined below;
3. The fiber was placed on a smooth non yielding surface;
4. Using a smooth convex tool, the fiber's thickness was compressed by rubbing the convex portion of the tool against the fiber's width area stroking the tool back and forth along its length. Using hand pressure of approximately 7 kg, approximately 20–40 strokes over a 4 cm portion of a 130 tex fiber are required to fully compress the fiber over the 4 cm region. One immediate indication as to whether sufficient pressure is being applied is found by looking at the expanded PTFE fiber's color change. When appropriate pressure is applied, the ePTFE fiber will change from a white opaque color to a clear-translucent color;
5. The compressed thickness of the fiber was measured using the snap gauge (to 0.0001") at several regions over the compressed fiber and the average compressed thickness [$T_c$] was computed;
6. The percent compression was computed using the following formula:

$$\% \text{ Compression}=(1-T_c/T_i)*100$$

Experiment Results:

| Sample | $T_i(\sigma)$ inch | $T_c(\sigma)$ inch | % Compress |
|---|---|---|---|
| Inventive fiber | 0.00365 (.00016) | 0.00185 (.0002) | 49.3 |
| RASTEX ® fiber | 0.00126 (.00005) | 0.00079 (.00007) | 37.3 |

As can be observed, the inventive fiber has a significantly improved degree of compressibility over any existing ePTFE fiber. The above test demonstrates that the inventive fiber is shown to have greater compressibility than RASTEX® fiber by 24%. It is believed that the fiber of the present invention will regularly experience a degree of compressibility of between 20 and 60% under the above described test, with a typical compressibility in excess of 40% being expected.

Another important property of the fiber of the present invention is its improved surface properties. One measure of the surface of the fiber is its surface roughness.

Surface roughness was tested using a non contact optical interferometric profiler capable of measuring step-heights from 100 angstroms to 100 micrometers on the Z-axis and surface roughness to greater than several micrometers. The instrument used for the testing was the model WYKO RST Surface/Step Tester which is available from WYKO Corporation, Tucson, Ariz.

The parameters for the interferometer follow: a 10× objective was used for the surface roughness analysis which provides profiles over a 422 μm×468 μm area and has a spacial sampling interval of 1.9 μm. A white light-single source with beam splitting was the source used during testing on the interferometer.

Below is a table outlining the surface roughness of the inventive fiber compared to a convental RASTEX® fiber characterized by peak to valley ratio, average roughness and root mean square (RMS).

| Measurement | Inventive Fiber μm | RASTEX ® μm |
|---|---|---|
| Ra<br>Ra = Average Roughness | 1.27 | 21.58 |
| Rq<br>Rq = Root Mean Square | 1.72 | 25.07 |
| Rt<br>Rt = Peak to Valley | 15.56 | 84.93 |
| SA | 1.017 | 1.037 |

SA Index = Scanned Area (400 × 400 μm)/Surface Area

The above data demonstrates that the inventive fiber has a smoother surface than the conventional fiber. A smoother fiber is thought to process better during the weaving process because the smoother fiber is thought to have less of a chance to fibrillate. Also, a smoother fiber is thought to provide superior release properties when woven into a sheet.

Definition:

The outer surface is defined as the unfolded and uncreased surface of a fiber which can be seen when exposed to ambient light as the fiber is rotated 360° around the fiber's center line which runs along the length of the fiber.

Without intending to limit the scope of the present invention, the following examples illustrate how the present invention may be made and used:

EXAMPLE 1

A fiber of the present invention was produced in the following manner.

A fine powder PTFE resin was combined in a blender with an amount of an odorless mineral spirit (Isopar K available from Exxon Corporation) until a compound was obtained. The volume of mineral spirit used per gram of fine powder PTFE resin was 0.264 cc/g. The compound was compressed into a billet and extruded through a 0.64 mm gap die attached to a ram type extruder to form a coherent extrudate. A reduction ratio of 85:1 was used.

Subsequently, the odorless mineral spirit was volatilized and removed, and the dry coherent extrudate was expanded uniaxially in the longitudinal direction 1.9 times its original length by passing the dry coherent extrudate over a series of rotating heated rollers at a temperature of 275° C. The dry coherent expanded extrudate was slit to 6.0 mm widths by passing it between a set of gapped blades. The slit coherent extrudate was expanded uniaxially in the longitudinal direction over hot plates at a temperature of 325° C. at a total ratio of 30 to 1 to form a fiber. This fiber was subsequently subjected to an amorphous locking step by passing the fiber over a heated plate set at a temperature of 400° C. for about 1 second.

The following measurements were taken on the finished fiber:

Width: 1.1 mm

Thickness: 0.089 mm

Weight/Length: 131 tex

Density: 1.34 g/cc

Tensile strength: 3600 g

Tenacity: 27.5 g/tex

EXAMPLE 2

A fiber of the present invention was produced in the following manner.

A coherent extrudate was produced in the same manner as in Example 1. Subsequently, the odorless mineral spirit was volatilized and removed, and the dry coherent extrudate was expanded uniaxially in the longitudinal direction 1.9 times its original length by passing the dry coherent extrudate over a series of rotating heated rollers at a temperature of 275° C. The dry coherent expanded extrudate was slit to 5.1 mm widths by passing it between a set of gapped blades. The slit coherent extrudate was expanded uniaxially in the longitudinal direction over hot plates at a temperature of 335° C. at a total ratio of 13 to 1 to form a fiber. This fiber was subsequently subjected to an amorphous locking step by passing the fiber over a heated plate set at a temperature of 400° C. for about 1 second.

The following measurements were taken on the finished fiber:

Width: 1.3 mm

Thickness: 0.130 mm

Weight/Length: 253 tex

Density: 1.50 g/cc

Tensile strength: 4630 g

Tenacity: 18.3 g/tex

EXAMPLE 3

A fiber of the present invention was produced in the following manner.

A coherent extrudate was produced in the same manner as in Example 1. Subsequently, the odorless mineral spirit was volatilized and removed, and the dry coherent extrudate was expanded uniaxially in the longitudinal direction 1.9 times its original length by passing the dry coherent extrudate over a series of rotating heated rollers at a temperature of 275° C. The dry coherent expanded extrudate was slit to 6.9 mm widths by passing it between a set of gapped blades. The slit coherent extrudate was expanded uniaxially in the longitudinal direction over hot plates at a temperature of 335° C. at a total ratio of 43 to 1 to form a fiber. This fiber was subsequently subjected to an amorphous locking step by passing the fiber over a heated plate set at a temperature of 400° C. for about 1 second.

The following measurements were taken on the finished fiber:

Width: 1.2 mm

Thickness: 0.069 mm

Weight/Length: 137 tex

Density: 1.67 g/cc

Tensile strength: 4450 g

Tenacity: 32.5 g/tex

EXAMPLE 4

A fiber of the present invention was produced in the following manner.

A coherent extrudate was produced in the same manner as in Example 1. Subsequently, the odorless mineral spirit was volatilized and removed, and the dry coherent extrudate was expanded uniaxially in the longitudinal direction 1.9 times its original length by passing the dry coherent extrudate over a series of rotating heated rollers at a temperature of 275° C. The dry coherent expanded extrudate was slit to 5.1 mm widths by passing it between a set of gapped blades. The slit coherent extrudate was expanded uniaxially in the longitudinal direction over hot plates at a temperature of 335° C. at a total ratio of 26 to 1 to form a fiber. This fiber was subsequently subjected to an amorphous locking step by passing the fiber over a heated plate set at a temperature of 400° C. for about 1 second.

The following measurements were taken on the finished fiber:

Width: 1.0 mm

Thickness: 0.091 mm

Weight/Length: 128 tex

Density: 1.40 g/cc

Tensile strength: 3590 g

Tenacity: 28.0 g/tex

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A fiber comprising:

a strand of expanded polytetrafluoroethylene (PTFE) of uniform dimensions in width along its entire length;

wherein the fiber has an outer surface of essentially rectangular to oblong cross-sectional dimension, the fiber being without folds so that its outer surface is fully exposed and is essentially flat;

wherein the fiber in an unfolded orientation comprises cross-section dimensions with a width of between about 0.5 to 3 mm and a thickness of at least 50 μm.

2. The fiber of claim 1 wherein the fiber is compressible, having a void volume between 13% and 55%.

3. The fiber of claim 1 wherein the fiber is woven into a fabric, the fiber retaining a flat orientation within the fabric so as to produce a flat woven fabric.

4. The fiber of claim 1 wherein the fiber is resistant to fibrillation.

5. The fiber of claim 1 wherein the fiber has sufficient void volume to allow the fiber to compress to at least 40% of its original thickness.

6. The fiber of claim 1 wherein the fiber is smooth having a surface finish of less than 15 μm RMS.

7. The fiber of claim 1 wherein the fiber has a density range between 1.0 and 1.9 grams/cc.

* * * * *